United States Patent [19]

Becquet

[11] 3,943,827

[45] Mar. 16, 1976

[54] PUMPS FOR MOTOR FLUID MECHANISMS

[75] Inventor: Jean E. Becquet, Seine-et-Oise, France

[73] Assignee: Poclain, Le Plessis-Bellevillie, France

[22] Filed: June 4, 1974

[21] Appl. No.: 476,264

[30] Foreign Application Priority Data

June 20, 1973 France ..... 73.22524

[52] U.S. Cl. ..... 91/488

[51] Int. Cl.[2] ..... F01B 1/00

[58] Field of Search ..... 91/488, 489

[56] References Cited

UNITED STATES PATENTS

| | | | |
|---|---|---|---|
| 2,300,009 | 10/1942 | Rose | 91/488 |
| 3,053,197 | 9/1962 | Lambeck | 91/488 |
| 3,142,262 | 7/1964 | Firth et al. | 91/488 |

*Primary Examiner*—William L. Freeh
*Assistant Examiner*—G. P. LaPointe
*Attorney, Agent, or Firm*—Mason, Fenwick & Lawrence

[57] ABSTRACT

The invention refers to an axial-piston pump or motor, having a piston which defines, with a cylinder, a chamber. A first end of the piston bears against a plate by means of a hydrostatic shoe having a cavity in the bearing face, a duct connecting the chamber to that cavity and being furnished with a constriction.

The piston has a recess which is arranged in the cylindrical portion of its second end remote from the first end, the constriction being constituted by the clearance lying between at least one collar portion of the piston which separates the recess from the chamber and the cylinder. A second recess is provided in the piston, the constriction being located between the first and second recesses.

The invention is applicable to the execution of a pump having high operational characteristics, particularly as far as concerns pressure.

3 Claims, 2 Drawing Figures

PUMPS FOR MOTOR FLUID MECHANISMS

Figure 1:
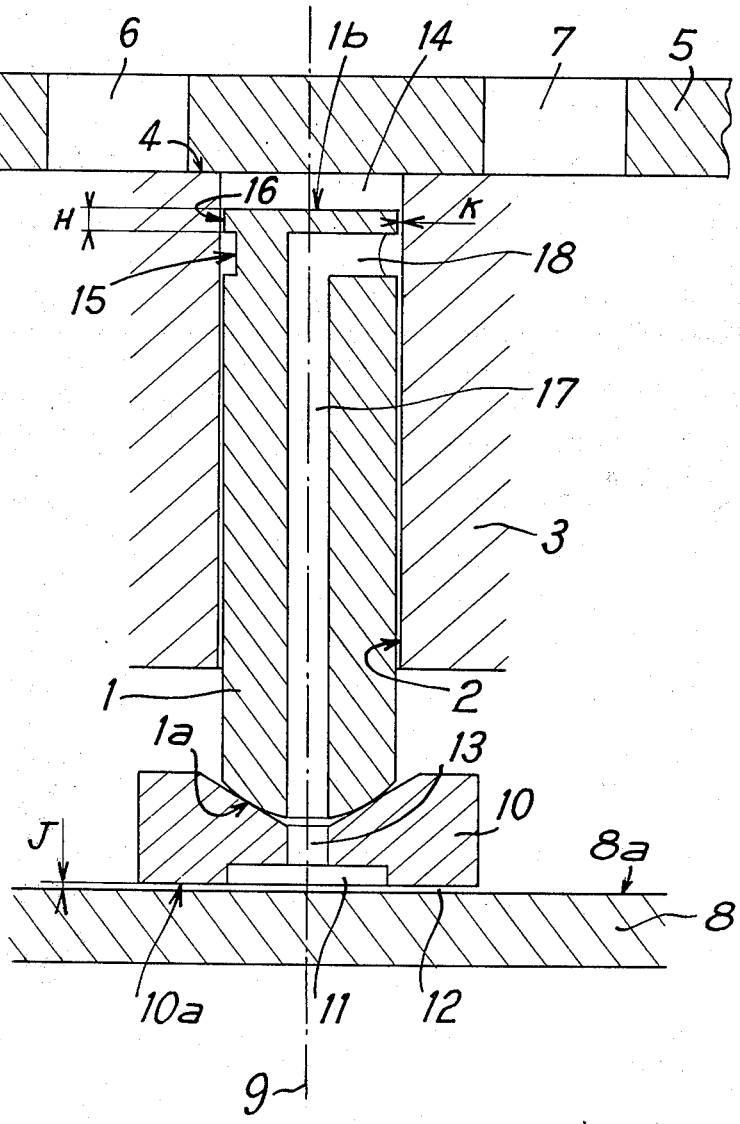

This invention is concerned with improvements in pumps or motor fluid mechanisms.

It is known that certain motor or pump piston-mechanisms have their pistons furnished with shoes bearing against a plate. These consist, for example, of variable-flow pumps in which the said plate is, in addition, of adjustable orientation.

A hydrostatic axial bearing is arranged in the shoe in order to facilitate its sliding on the plate. The feed with fluid under pressure is ensured in known manner from the fluid under pressure contained in the chamber defined by the piston in question, by means of a duct arranged in the piston. A constriction consisting up to now of a calibrated nozzle is arranged in this duct.

The need of a calibrated nozzle introduces well known disadvantages due to calibration of small parts and in addition, on the functional plane, leads to unforeseeable modifications of the characteristics of the bearing because of impurities which in service come to block the said nozzle partially or totally.

The present invention has the intention of correcting this state of things and proposes in order to do this a piston of a new type in which the constriction by cleaning itself in the course of operation avoids the aforesaid risks of blocking.

According to this invention there is provided a motor or pump fluid-mechanism, including a piston, a cylinder in which the piston is slidable and with which the piston defines a chamber into which fluid is admitted and delivered successively during operation, a first end bearing a reaction plate, a hydrostatic shoe bearing on the plate, engaged by a first end of the piston and having a cavity in the bearing face, a first recess in the cylindrical portion of the second end of the piston remote from the first end, a duct connecting the cavity to the first recess, and a constriction which is constituted by the clearance lying between at least one collar portion of the piston separating the first recess from the chamber, and the cylinder, a second recess being arranged in the said collar portion, which is distinct from the first recess and which is in permanent communication with the chamber by means of a secondary duct bored in this piston, the construction constituted by the clearance lying between the portion of the collar separating the first recess from the second recess, and the cylinder, Preferably the duct connecting the cavity to the first recess is internal to the piston, the said internal duct comprises a first portion which extends substantially parallel with the axis of the piston and which opens out of the said piston through the first end and a second portion which extends substantially radially in the piston and which connects the said first recess to the first portion of this internal duct.

The invention will be better understood and secondary characteristics as well as their advantages will become apparent in the course of the description of embodiment given below by way of example.

It is to be understood that the description and the drawings are given only by way of indication and non-restrictively.

Figure 2:
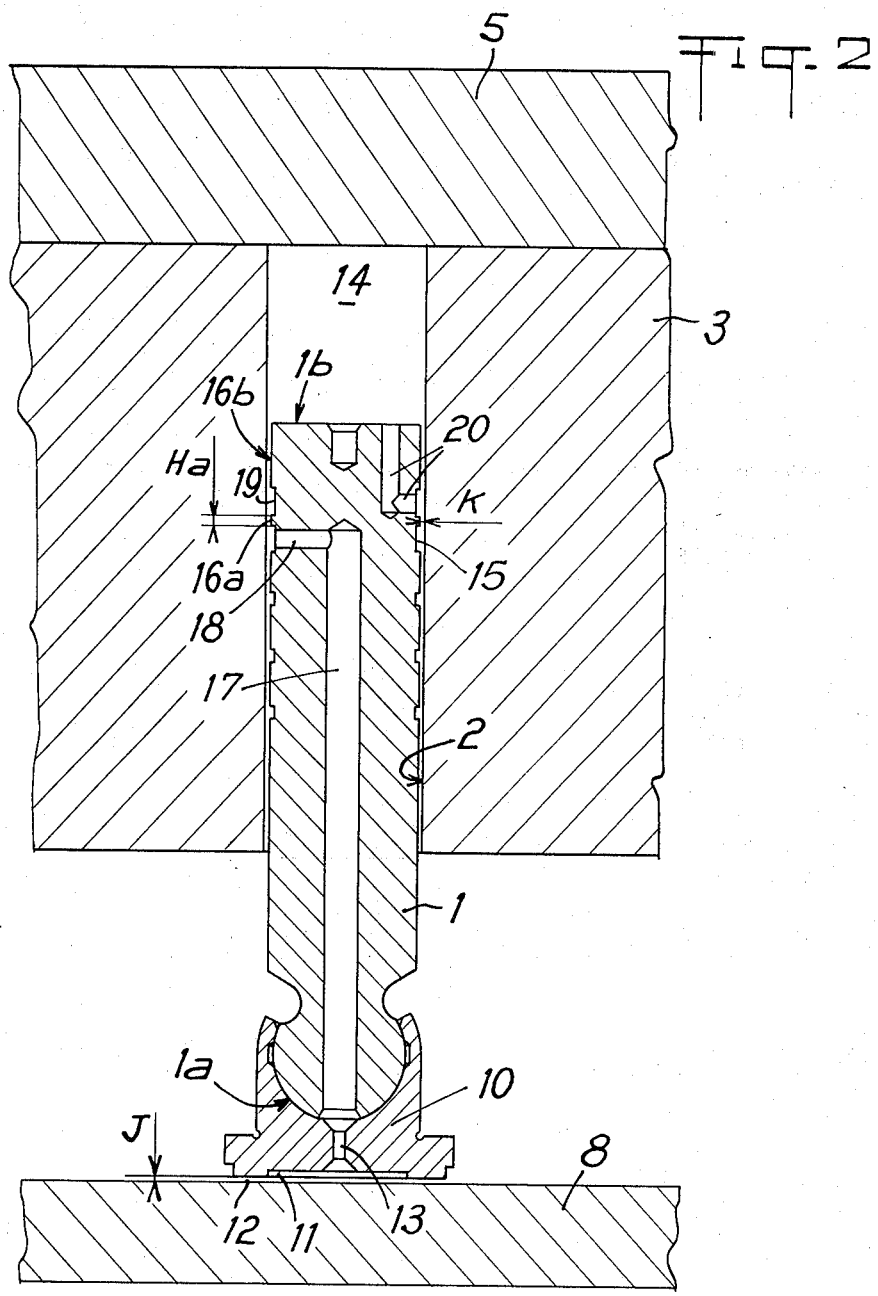

Reference will be made to the attached drawings in which:

FIGS. 1 and 2 are axial sections of two variants in execution of a piston, the variant of FIG. 2 being in accordance with the invention.

Referring to FIG. 1 it will be observed that a piston 1 is mounted to slide in the bore 2 of a cylinder arranged in the cylinder-block 3 of an axial-piston pump. One of the end transverse faces, the face 4 of the cylinder-block 3 is arranged opposite a fluid distribution facing 5 which has an inlet port 6 and an exhaust port 7. The cylinder-block 3 is moreover mounted to rotate with respect to the distribution facing 5 about an axis perpendicular to its plane face 4.

The pump likewise includes a plate 8 which is inclined with respect to the axis 9 of the piston 1 about an axis parallel with the plane of the Figure. The piston 1 bears at a first end 1*a* against a shoe 10 which in turn bears against the plate 8. In fact a cavity 11 is arranged in the face 10*a* of the shoe 10, which is arranged opposite the plate 8 and is fed with fluid under pressure through a hole 13 drilled in the shoe 10. The shoe 10 consequently constitutes a hydrostatic bearing, a fluid film 12 being interposed between the face 10*a* of the shoe 10 and the face 8*a* of the plate 8 arranged opposite. The faces 8*a* and 10*a* are separated by the value of an operational clearance J.

A chamber 14 is defined by the second end 1*b* of the piston 1, the bore 2 and the distribution facing 5 and is put in communication successively with the ports 6 and 7. It is to be observed that a recess 15 is arranged in the cylindrical portion of the piston 1 next to the end 1*b* and is separated from the end face 1*b* by a collar 16. A diametral assembly clearance K is arranged between the collar 16 and the bore 2 of the cylinder.

It will be observed finally that a duct with two arms 17 and 18 arranged in the piston 1 permanently connects the hole 13 drilled in the shoe 10 to the recess 15. The arm 17 of the duct is coaxial with the piston 1 and opens out at the end 1*a* of the piston 1 opposite the hole 13, whereas the arm 18 which extends radially in the piston 1 connects the recess 15 to the arm 17.

The variant illustrated in FIG. 2 repeats the elements already indicated previously and referenced by the same reference numbers. It will be observed, however, that the single collar 16 of the piston as FIG. 1 is replaced by a collar in two portions 16*a* and 16*b*, the latter being defined by the end face 1*b* of the piston 1, whilst a second recess 19 separates the two said portions 16*a* and 16*b* and the portion 16*a* is in turn arranged between the recesses 15 and 19. A secondary duct 20 drilled in the piston 1 connects the end face 1*b* of the said piston 1 to the recess 19.

It may again be indicated that the arms 17 and 18 of the duct connecting the recess 15 to the hole 13 have any sort of dimensions and in particular do not have the necessity of being calibrated. On the other hand the height H of the collar 16 and the diametral clearance K which separates it from the bore 2, and similarly the height H*a* of the portion 16*a* and again the diametral clearance separating the said portion 16*a* from the bore 2, must have relatively accurate values. In fact the cylindrical passage arranged by this clearance K constitutes a constriction the value of which intervenes in the characteristics of the hydrostatic bearing comprising the cavity 11 and the clearance J.

The functioning of the arrangements which have been described is very simple. The fluid under pressure contained in the chamber 14 communicates with the recess 15 by means of the constriction arranged between the collar 16, in the case of FIG. 1, or the portion 16*a* of the collar in the case of FIG. 2, and the bore 2 of the cylinder. The fluid in the recess 15 therefore feeds without the interposing of any constriction whatever, the cavity 11 and the fluid film 12.

Because of the sliding of the piston 1 in the bore 2 an impurity interposed between the collar 16 (or the portion 16*a* and the bore 2 would be displaced automatically. It is found actually in service that no impurity comes to be inserted in the clearance K. Consequently the value of the constriction remains quite definite and constant on an average over a period. Furthermore this constriction is much easier to execute than a calibrated nozzle.

It is known further that the clearance between the piston 1 and the bore 2 has its greatest variations at the ends of the said piston. According to this way of thinking, the execution as FIG. 1 can lead to troublesome instantaneous variations in the clearance K. In order to mitigate this disadvantage the execution as FIG. 2 can be adopted, in which the clearance K between the portion 16*a* and the bore 2 is much less affected by variations in the head of the piston, the said portion 16*a* not being directly next to the end 1*b* of the said piston.

The invention is not limited to the embodiments which have been given but on the contrary covers any variants upon them which might be applied to it without departing from its scope or its spirit.

What is claimed is:

1. A motor or pump fluid-mechanism including a piston having a cylindrical sidewall, a cylinder in which said piston is slidably mounted for axial movement, one end face of said piston defining one end of a chamber in said cylinder into which chamber fluid is admitted and delivered successively during operation of said mechanism, a reaction plate, a hydrostatic shoe bearing on said reaction plate, said hydrostatic shoe engaging the end of said piston opposite said one end face and having a bearing face adjacent and facing said reaction plate, a cavity in said bearing face facingly adjacent said reaction plate, a first recess in said cylindrical sidewall portion of said piston adjacent the end of the piston remote from the end of the piston engaging said reaction plate, a duct connecting said cavity to said first recess for providing fluid communication therebetween, a second recess in the cylindrical wall portion of the piston located between and spaced from said first recess and said first end face of said piston, a collar portion of said piston separating said first recess from said second recess with said collar not contacting said cylinder, a constriction constituted by the clearance space lying between the outer periphery of said collar portion of the piston and the cylinder providing restricted flow communication between said second recess and said first recess and a secondary duct bored in the piston between said chamber and said second recess for providing fluid communication between said chamber and said second recess whereby hydraulic pressure in said chamber is communicated to said secondary duct to said second recess then through said constriction to said first recess then to said cavity through said duct connecting said first recess and said cavity thereby providing constant flow characteristics between said chamber and said cavity which does not vary as the piston cylindrical sidewall wears because the collar portion of the piston does not contact the cylinder wall and therefore provides an essentially constant flow of construction which is self-cleaning.

2. The invention of claim 1 wherein said duct connecting said cavity to said first recess is positioned internally of the piston.

3. The invention of claim 2 wherein said internal duct comprises a first portion extending substantially parallel to the axis of said piston and having one end in communication with said end face of said piston and having its opposite end communicating with a second portion extending substantially radially in said piston and having its outer end in communication with said first recess.

* * * * *